United States Patent [19]

Koch et al.

[11] 4,343,238

[45] Aug. 10, 1982

[54] COUNTING OR PRINTING MECHANISM FOR CONSECUTIVE COUNTING NUMBERING

[75] Inventors: Ulf Koch, Eberbach; Gerhard Nagel, Hirschhorn, both of Fed. Rep. of Germany

[73] Assignee: Esselte Pendaflex Corporation, Garden City, N.Y.

[21] Appl. No.: 216,497

[22] Filed: Dec. 15, 1980

[30] Foreign Application Priority Data

Jan. 16, 1980 [DE] Fed. Rep. of Germany ..... 3001321

[51] Int. Cl.[3] ..... B41J 45/00

[52] U.S. Cl. ..... 101/85; 101/110; 235/1 C

[58] Field of Search ..... 101/110–111, 101/72–77, 79, 85, 88–89, 95–97, 45; 235/1 C, 56

[56] References Cited

U.S. PATENT DOCUMENTS

| | | | |
|---|---|---|---|
| 1,695,964 | 12/1928 | Lang | 101/72 |
| 2,966,843 | 1/1961 | Eckley | 101/110 |
| 3,738,264 | 6/1973 | Sobottka et a. | 101/110 |
| 3,884,144 | 5/1975 | Shimodaira | 101/110 X |
| 3,927,613 | 12/1975 | Nantz | 101/110 |
| 4,055,116 | 10/1977 | Roberts et al. | 101/72 X |
| 4,149,460 | 4/1979 | Sato | 101/110 |

FOREIGN PATENT DOCUMENTS

| | | | |
|---|---|---|---|
| 1028138 | 4/1958 | Fed. Rep. of Germany | 101/72 |

*Primary Examiner*—E. H. Eickholt

*Attorney, Agent, or Firm*—Fidelman, Wolffe & Waldron

[57] ABSTRACT

A counting or printing mechanism for consecutive counting or numbering, in which a number or printing wheel is provided for each numerical place and the number or printing wheels are mounted on a common shaft. The number or printing wheels are turned by advancing elements which are connected loosely but so as to transmit force and designed to deflect one another. These advancing elements may, for example, be pawls disposed on an inner ring or coupling discs disposed on a side surface of the number or printing wheels.

14 Claims, 18 Drawing Figures

COUNTING OR PRINTING MECHANISM FOR CONSECUTIVE COUNTING NUMBERING

The invention relates to a counting or printing mechanism for consecutive numbering, in which a number or printing wheel is provided for each numerical place and the number or printing wheels are mounted on a common shaft and are individually lockable, while the said wheels are also adapted to be turned by one or more advancing devices to consecutive counting or printing positions and to be coupled together in a determined advancing rhythm.

A counting mechanism of this kind is suitable for printing apparatus, for example in hand labelling machines in which the number wheels are designed as printing wheels. A printing apparatus of this kind is known from DE-GM No. 7 331 334, in which the printing wheels are strung on a shaft. Parallel to this shaft is disposed a second shaft, on which are mounted a ratchet wheel, working with a pawl, and a control wheel for advancing the next following ratchet wheel in each particular case. A control rim integrally joined to the ratchet wheel is provided on one side of the latter, while on the other side a ratchet rim is provided. This ratchet rim has a smaller radius than the control rim of the neighbouring ratchet wheel. Associated with each printing wheel is a ratchet wheel provided with a toothing whose radius is greater than the radii of the ratchet rims and control rims. The ratchet wheel is turned by a pawl which engages from outside in the respective ratchet rim joined to the ratchet wheel. The teeth of the ratchet rim engage in turn in gaps which are formed by printing wheel teeth carrying the numbers which are to be printed. A printing unit of this kind requires a comparatively large amount of space, since two shafts extending parallel side by side and also a pawl arrangement parallel to the shaft and to the ratchet wheel are required, while the ratchet wheels, which have a plurality of teeth and therefore are subject to wear, must be fitted between the printing wheels and the pawl arrangement. It is however necessary that a hand labelling machine should be handy and strong.

In another known form of hand labelling machine, in which the printing wheels are advanced automtically, a ratchet rim is disposed at the side of each printing wheel and connected to the latter without rotary play. The printing wheel of the next higher numerical place immediately adjoins the ratchet rim of a printing wheel, so that gaps of roughly the thickness of the material of a ratchet rim are formed between the printing wheels. Pawls rigidly joined together in a ratchet comb and cooperating with the ratchet rims for the purpose of turning the printing wheels engage in these gaps. In this printing unit the diameters of the ratchet rims are equal in size, while the ratchet comb is stepped. As the numerical place rises progressively, the ratchet comb consequently engages more and more deeply in the ratchet rims. The number of numerical places is therefore limited in this apparatus. Without stepping-down of the advance, the ratchet rim associated with the printing figure of the lowest order is in continuous engagement with the pawl associated with it. The corresponding printing wheel is therefore moved one angular step for each printing stroke. The pawls previously disconnected for the higher order printing wheels are engaged when the nine of the lower order printing wheel is in the printing position.

In addition to the limited number of numerical places, this printing unit also has other undesirable disadvantages for a hand labelling machine. It requires a great deal of space because of the rigidly coupled pawls disposed at the side of the printing wheels and acting from the periphery. Even the ratchet rim for the lowest numerical place is limited in respect of its possible outside diameter by the practical need for handiness. Furthermore, the arrangement of ratchet rims between the printing wheels produces in the printed pattern a gap between two neighbouring printed characters, the width of this gap corresponding at least to the thickness of the material of the ratchet rim and pawl. As a result, not only is the printed pattern impaired, but the density of information on a printed label is also reduced. The requirements of strength and operating reliability of a hand machine impose limits on the self-suggesting remedy of making the ratchet rim and pawl as thin as possible with a view to keeping the gaps in the printed pattern small. Moreover, in the dimensioning of the ratchet rim and pawl the resistance to wear of these precision parts, which are manufactured with close tolerances, is a factor which dictates the design.

The invention seeks to provide a wear-resistant numbering or printing mechanism for consecutive counting or numbering, which is also particularly suitable for printing apparatus and in which, while it requires minimum space, a large number of manually preselectable, automatically advanced number or printing wheels can be disposed side by side without gaps.

This problem is solved by a counting or printing mechanism of the type first defined above through the fact that for the direct and also stepped-down advancing of the number or printing wheels there are provided advancing elements of the advancing device or devices, which elements are adapted to be connected together loosely but so as to transmit force and are also designed to deflect one another.

Advantageous forms of construction of a counting or printing mechanism of this kind are characterised in the sub-claims.

In the counting or printing mechanism of the invention the components are kept to a minimum number. No gears, which are subject to wear, engage one in the other, but pawls or coupling discs act from inside or from the side, or else on the outside diameter of each number or printing wheel, which on the drive side is provided on its inner ring or on its side face with a corresponding gear rim or stepped rim. In the preferred embodiments the entire advancing mechanism is disposed practically inside the number or printing wheel, so that the dimension of the entire counting or printing mechanism is determined substantially by the size of the wheels, while only one locking shaft is provided, on which these wheels are strung and disposed one against the other without gaps, so that complete utilisation of the space of the printing apparatus is possible.

The invention will be explained more fully with the aid of two examples of embodiment which are illustrated in the accompanying drawings, with a description of printing mechanisms. In these drawings.

Figure 1:
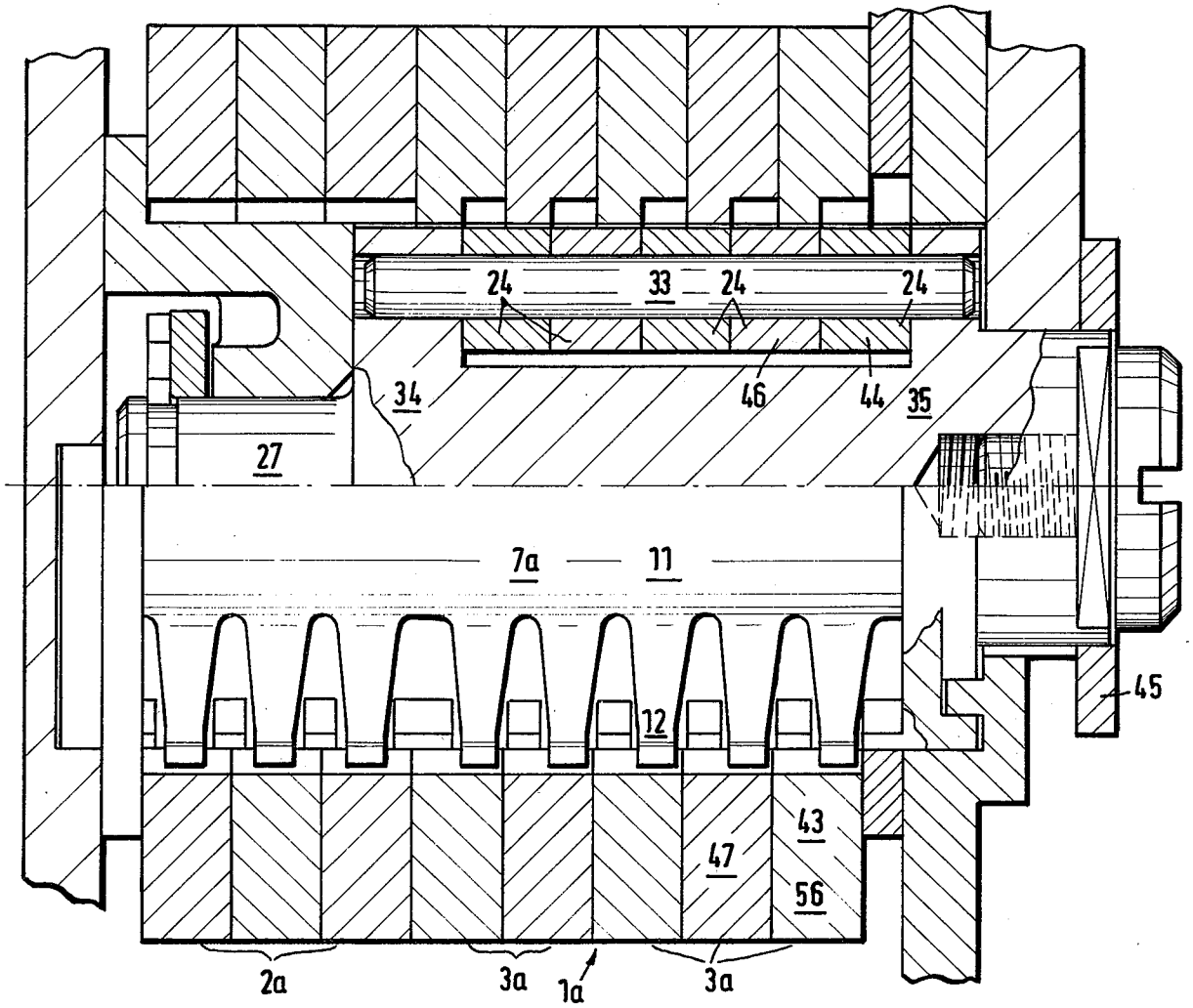
FIG. 1 is a view in longitudinal section of a first form of construction of the printing mechanism of the invention, in which advancing is effected by means of pawls.
Figure 3:
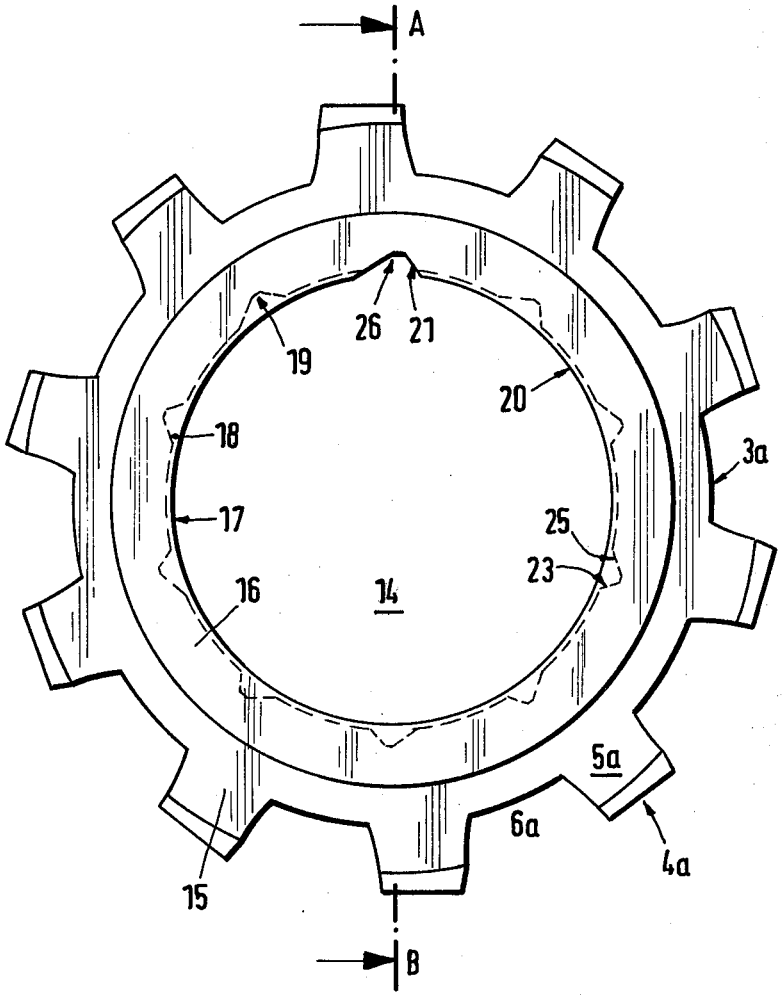
FIG. 3 is a plan view of a printing wheel in the embodiment shown in FIG. 1.
Figure 4:
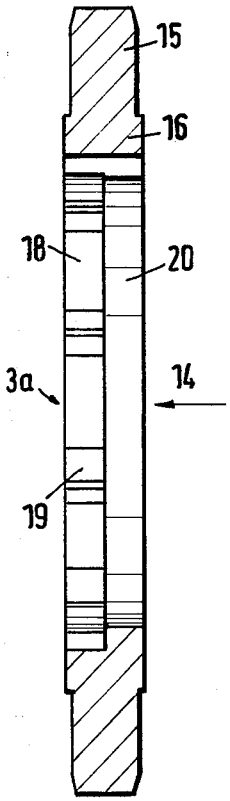
Figure 5:
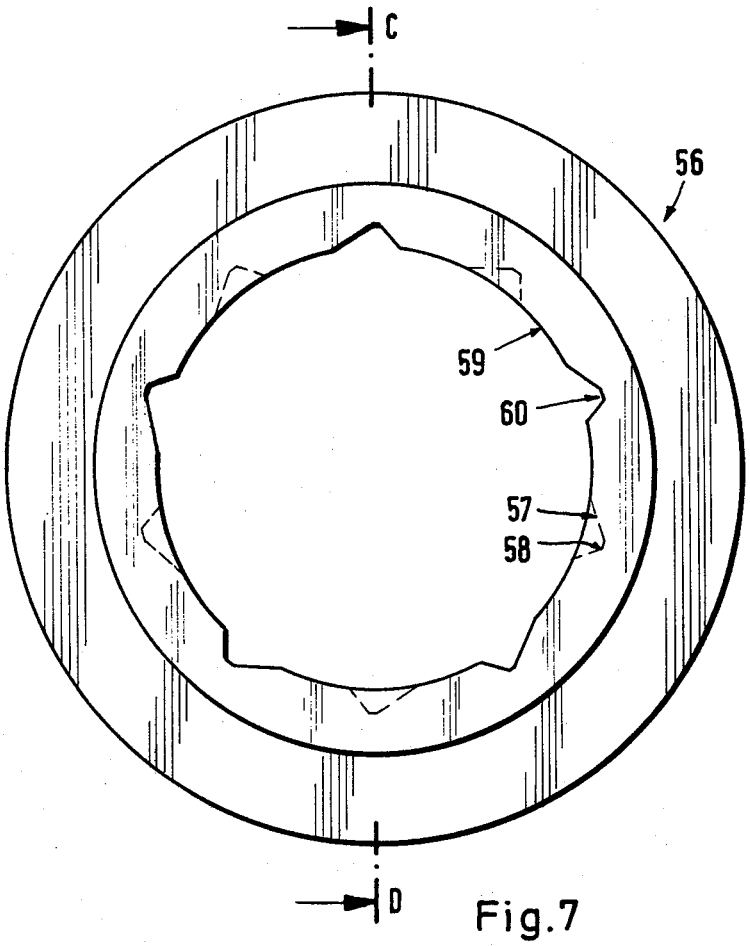
Figure 6:
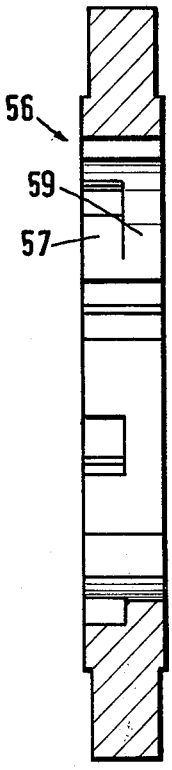
Figure 7:
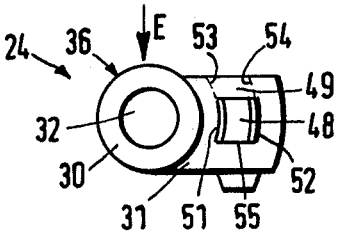
Figure 8:
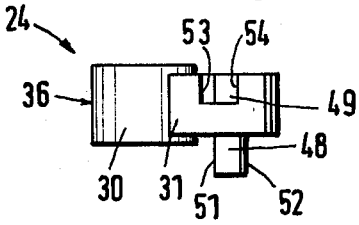
Figure 9:
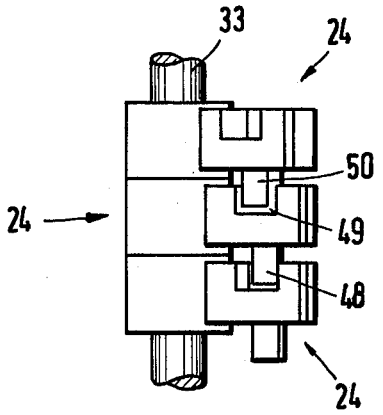
Figure 11:
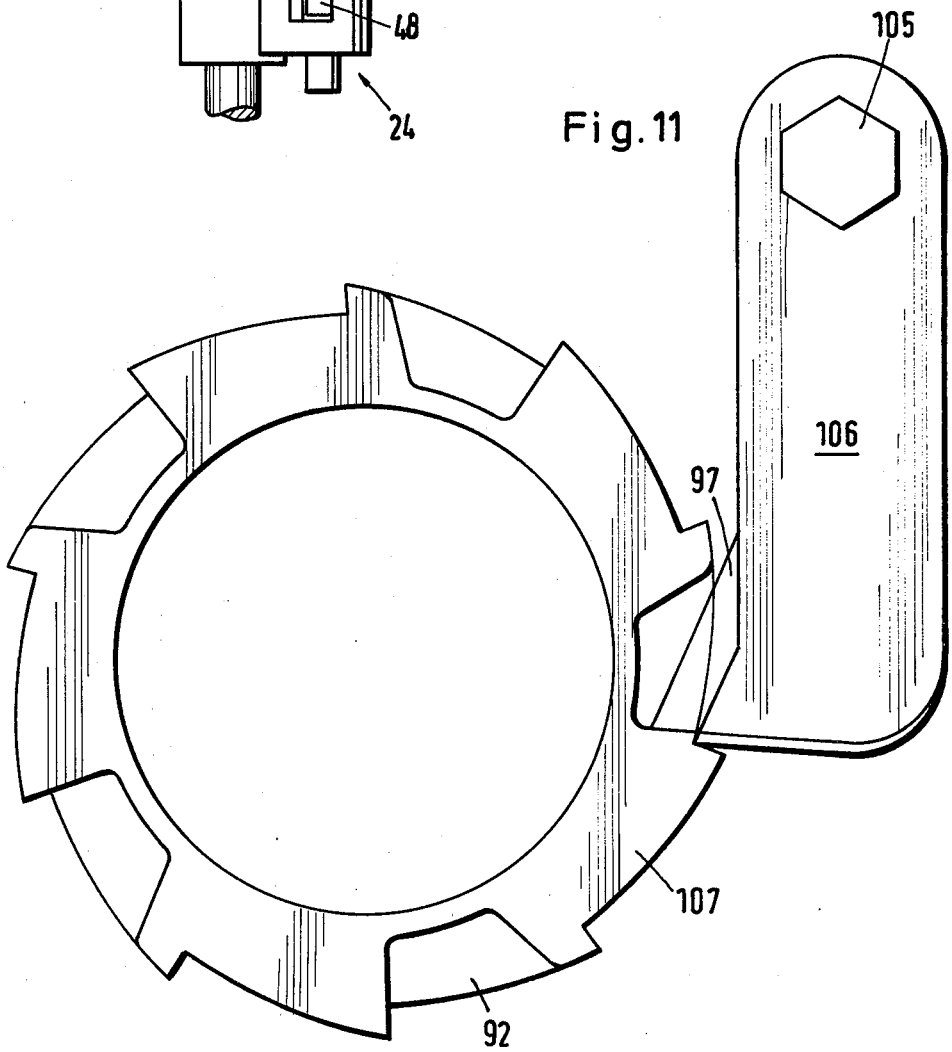
Figure 10:
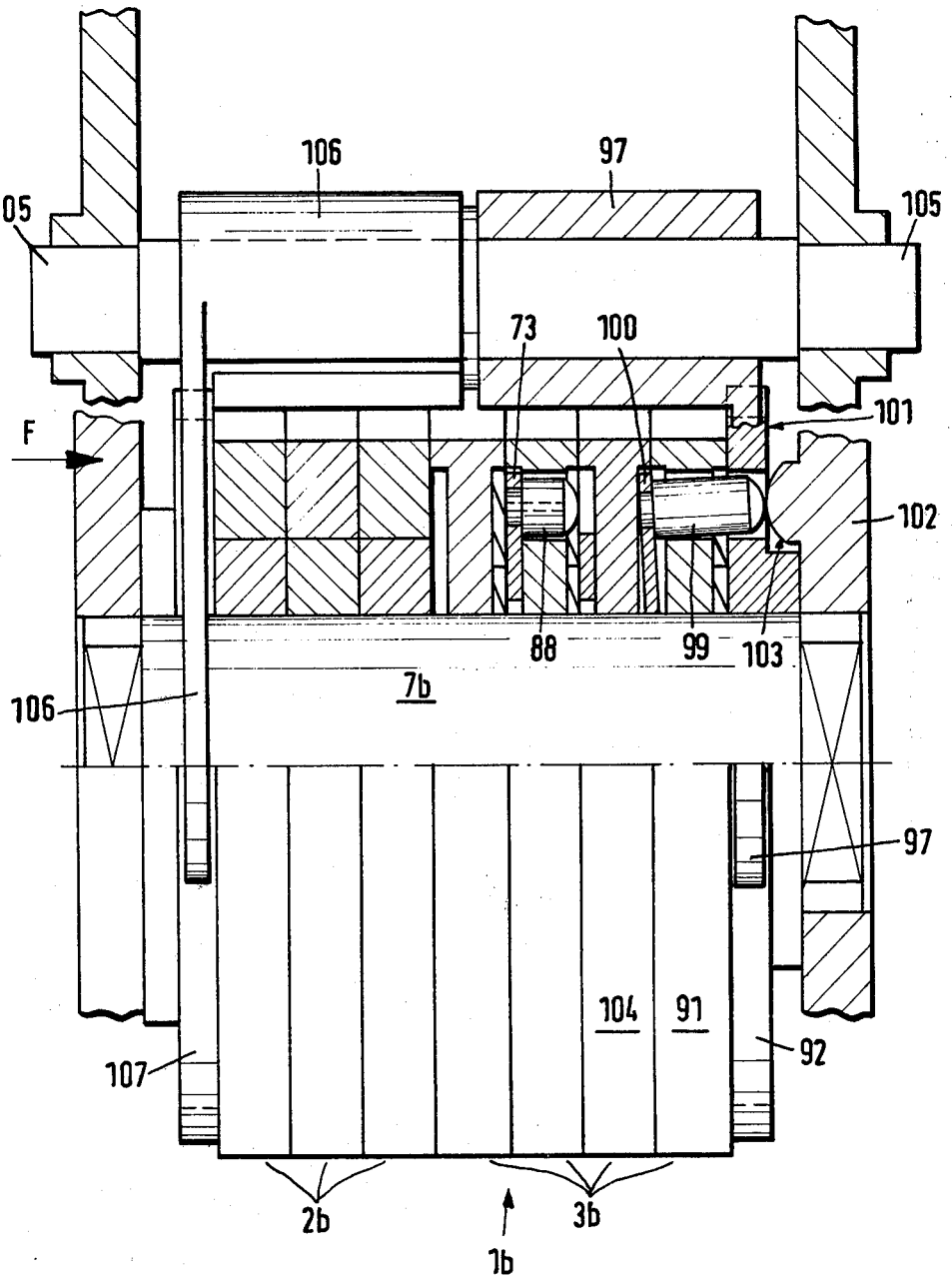
Figure 12:
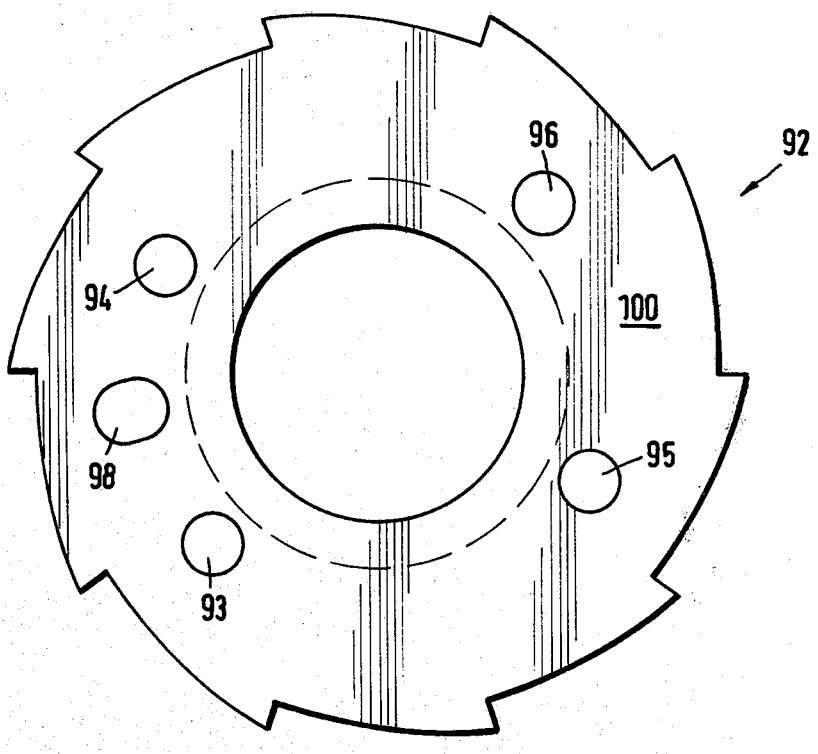
Figure 13:
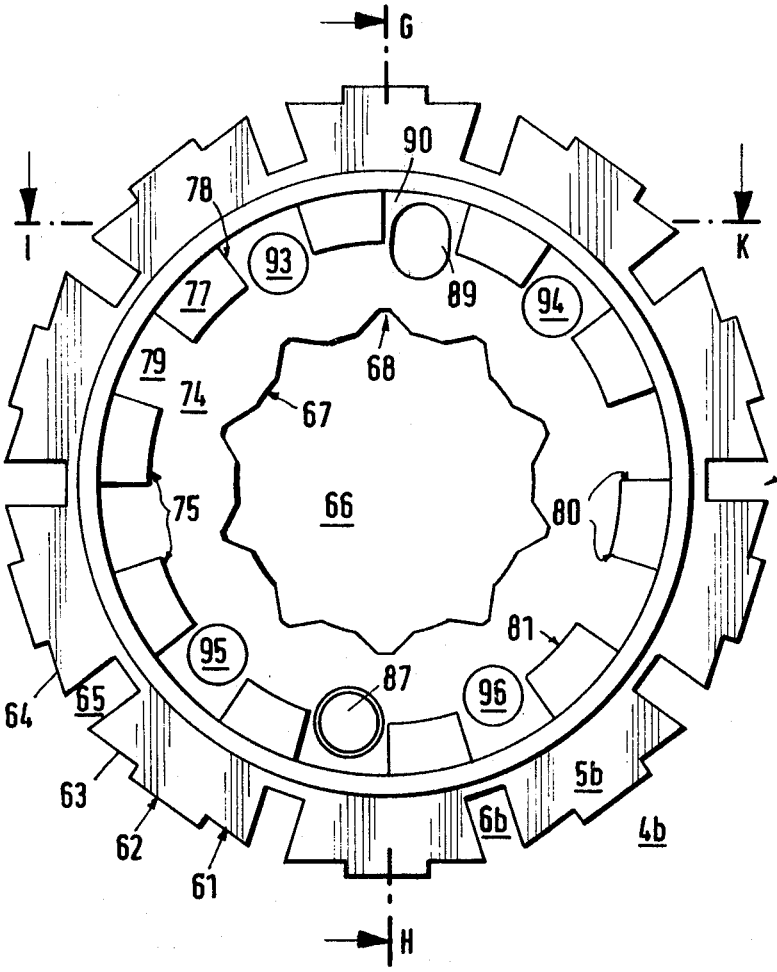
Figure 14:
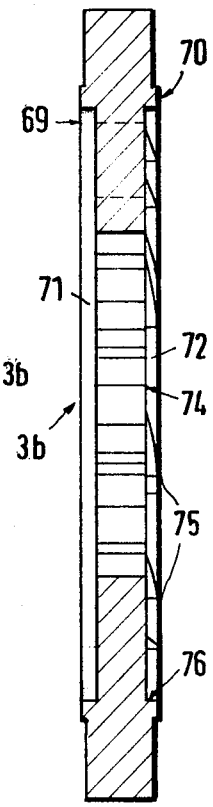
Figure 15:
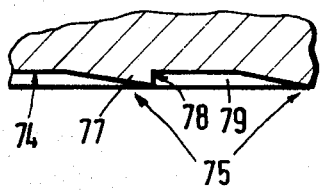
Figure 16:
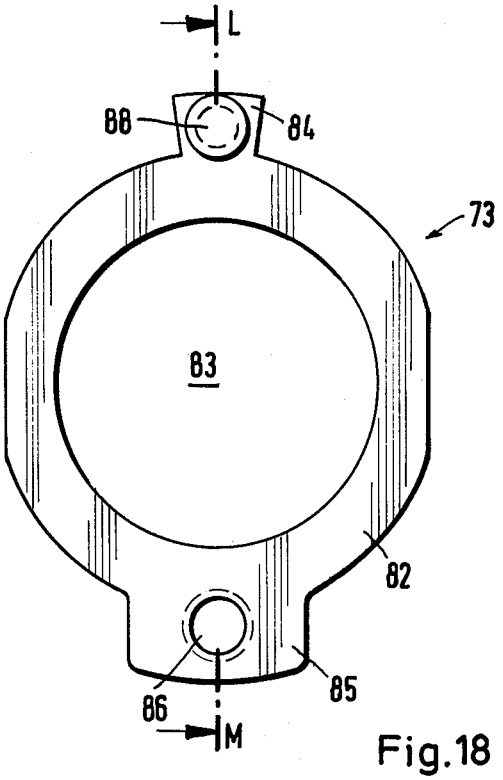
Figure 17:
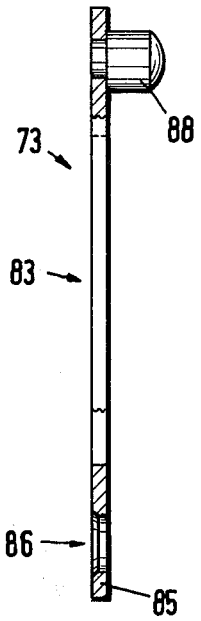
Figure 18:
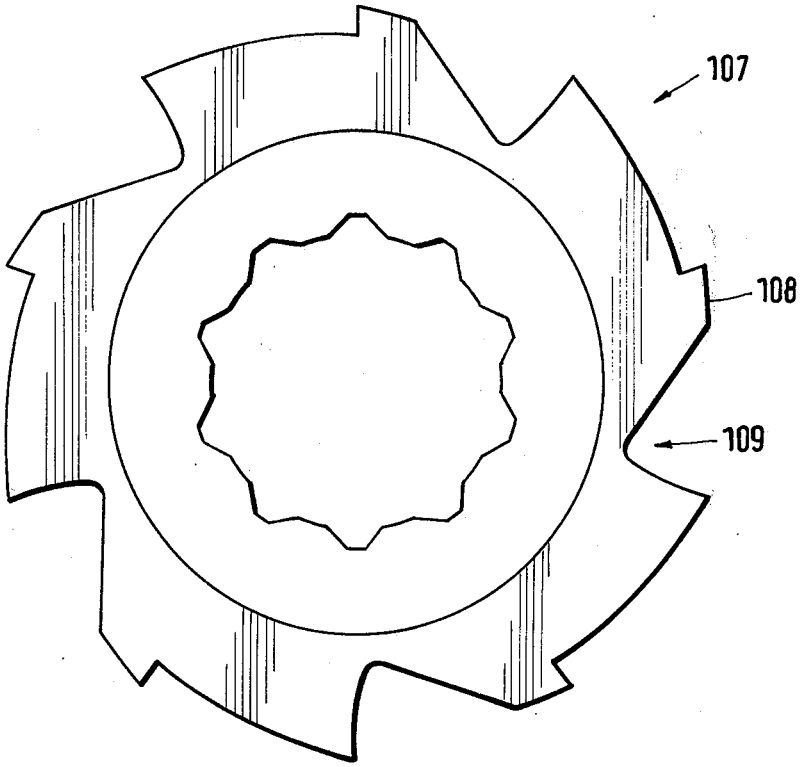

FIG. 4 a side view in section on the line A-B in FIG. 3;

FIG. 5 a plan view of a control disc in the embodiment shown in FIG. 1;

FIG. 6 a side view in section of the control disc on the line C-D in FIG. 5;

FIG. 7 a side view on a larger scale of a pawl in the embodiment shown in FIG. 1;

FIG. 8 a plan view of the pawl, viewed in the direction "E" in FIG. 7;

FIG. 9 a plan view, corresponding to FIG. 8, of three mounted pawls in the embodiment shown in FIG. 1;

FIG. 10 a longitudinal sectional view of a second form of construction of the printing mechanism according to the invention, in which the advancing is effected by means of coupling discs;

FIG. 11 is a side view of this second embodiment, viewed in the direction "F" in FIG. 10;

FIG. 12 is a plan view of a ratchet rim in the embodiment shown in FIG. 10;

FIG. 13 is a plan view of a printing wheel in the embodiment shown in FIG. 10;

FIG. 14 a side view in section of the printing wheel, taken on the line G-H in FIG. 13;

FIG. 15 a partial side view in section of the printing wheel, taken on the line I-K in FIG. 13;

FIG. 16 a plan view of a coupling disc in the embodiment shown in FIG. 10;

FIG. 17 a side view in section of the coupling disc, taken on the line L-M in FIG. 16, and FIG. 18 a plan view of a step-down cam in the embodiment shown in FIG. 10.

In both exemplified embodiments illustrated the automatically advancing printing mechanism 1a;1b according to the invention is combined with printing wheels 2a;2b which are adjustable only manually. This arrangement is used in labelling machines, in which a label is printed with a fixed, predetermined mark—for example a date or price mark—and at the same time with a serial number. The pre-adjusted printing wheels with a fixed setting, which generally remain unchanged for a lengthy printing run, are designated 2a;2b and together with the automatically advanced printing wheels 3a;3b are mounted on a common shaft. The printing wheels are gear wheels which coincide in respect of the outside diameter of their gear rims and in each case are operated by a common actuator (not shown). In the usual case of decimal numbering the progressive printing wheels 3a,3b have ten-digit symmetry, and carry on the end faces 4a;4b of their ten teeth 5a;5b, which have an angular spacing of 36°, the digits from zero to nine. The fixed printing wheels 2a;2b on the other hand may have other printing characters in place of or in addition to the decimal numbers, and thus also if desired have a different symmetry. For each printing wheel 2a,3a or 2b,3b there is provided an adjusting wheel (not shown) with identical symmetry, the teeth of this adjusting wheel engaging in the corresponding tooth gaps 6a or 6b in the printing wheel. Like the printing wheels, the adjusting wheels are disposed on a common shaft, which extends parallel to the axis of the printing wheels. The adjusting wheel shaft is a hollow cylinder, in whose interior an axially displaceable coupling shaft is guided. The coupling shaft is turned manually with the aid of an adjusting knob, so that with the aid of an operating member it engages in any desired adjusting wheel and drives the latter. Through the engagement of the adjusting wheel in the outer gear rim of the printing wheel 2a;3a or 2b;3b, the corresponding printing wheel is thus moved at the same time. The character on the printing wheel 2a;3a or 2b;3b which faces the printing surface at any given moment can be seen through the markings on the adjusting wheel; these can be read through a viewing window.

The printing wheels 2a;3a or 2b;3b are laterally supported one against the other in direct succession on a common shaft, but are adapted to be moved individually independently of one another. This shaft is a locking shaft 7a or 7b, which positions and adjusts the printing wheels 2a;3a or 2b;3b in various angular positions which are offset in steps relative to one another.

The locking shaft 7a in the embodiment shown in FIG. 1 is a cylindrical sleeve 8, on whose outer peripheral surface 9 a spring comb 10 is disposed. The spring comb 10 consists of a comb back 11, from which project, like prongs, as many leaf springs 12 as there are printing wheels 2a;3a provided on the locking shaft 7a. The comb back 11 is mounted, parallel to the cylinder axis of the sleeve 8, in a spring bed 13 inside the peripheral surface 9 of the sleeve 8, and is made fast to the latter by screws or pins. The comb back 11 is recessed in the peripheral surface 9 of the sleeve 8, while the individual leaf springs 12, in their unstressed position, project tangentially out of the peripheral surface 9 of the sleeve 8 or follow the peripheral surface 9 with a radius of curvature which is slightly greater than the radius of the circle of the sleeve 8. In the unloaded state the leaf springs 12 thus project from the periphery of the sleeve 8 over at least a part of their length. The spring bed 13 receiving the comb back 11 is in turn continued over the peripheral surface 9 for a length of arc which corresponds to the length of the leaf springs 12. Through radial pressure the leaf springs 12 are moved back into the spring bed 13, that is to say into a region inside the peripheral surface 9 of the sleeve 8, from which they spring back radially outwards because of their natural elasticity.

The peripheral surface 9 of the sleeve 8 forms the bearing surface of the printing wheels 2a;3a. The printing wheels 2a;3a have a central bore 14, whose inside diameter corresponds to the diameter of the sleeve 8, and they are stung on the sleeve 8.

With the aid of FIGS. 3 and 4 an automtically advanced printing wheel 3a will be explained more fully; this printing wheel is provided in a manner known per se with a type rim gear 15 whose teeth 5a carry on their end faces 4a the printing digits from zero to nine. The thickness of the material of the type rim gear 15 is slightly less than that of the remainder of the printing wheel body 16. An adjusting wheel (not shown) engages in the manner described in the type rim gear 15.

The inner ring 17 formed by the centre bore 14 of the printing wheel body 16 is provided on its driving side with a rim gear 18 having ten identical, uniformly spaced detent notches 19, which serve for the decimal advance of the printing wheel 3a. On the driven side of the printing wheel 3a the inner ring 17 is provided with a rim gear 20, in which only a single detent notch 21 is formed.

The rim gears 18 and 20 on the driving and driven sides of the printing wheel 3a respectively serve equally for the adjustment of the printing wheels 3a to printing positions offset stepwise relative to one another, as for the decimal progression of the printing mechanism 1a.

On the rim gear 18 on the driving side of each printing wheel 3a runs the end of a leaf spring 12 of the spring comb 10, this end being bent to form a hook 22. The leaf spring 12 is pressed radially back into the spring bed 13 by the printing wheel 3*a* mounted on the locking shaft 7*a*. As soon as the hook 22 coincides with a detent notch 19 in the rim gear 18 on the driving side on rotation of the printing wheel 3*a*, it falls resiliently into the said notch and locks the printing wheel 3*a* in the corresponding printing position.

The detent notches 19 and 21 are preferably recesses in the solid material of the printing wheel body 16, and in lateral projection (FIG. 3) appear as practically right-angled triangles. The surface 23 associated with the shorter leg of the triangle acts as a stop surface for pawls 24 which engage in the detent notches 19 or 21, and which act against the surface 23 and thus move the printing wheel 3*a*. The surface 25 associated with the longer leg acts on the other hand as a sliding path, by means of which the pawls 24 can be lifted out of their engaged position.

The individual detent notch 21 of the rim gear 20 on the driven side is in line with one of the detent notches 19 in the rim gear 18 on the driving side. The printing wheel body 16 therefore has a single continuous detent notch 26, while the other detent notches are each formed for example only in half the thickness of the material of the printing wheel body 16. The arrangement of the through-notch 26 relative to the type rim gear 15 is so selected that the pawls 24 come into engagement with the through-notch 26 when the digit nine faces the printing surface.

Figure 2:
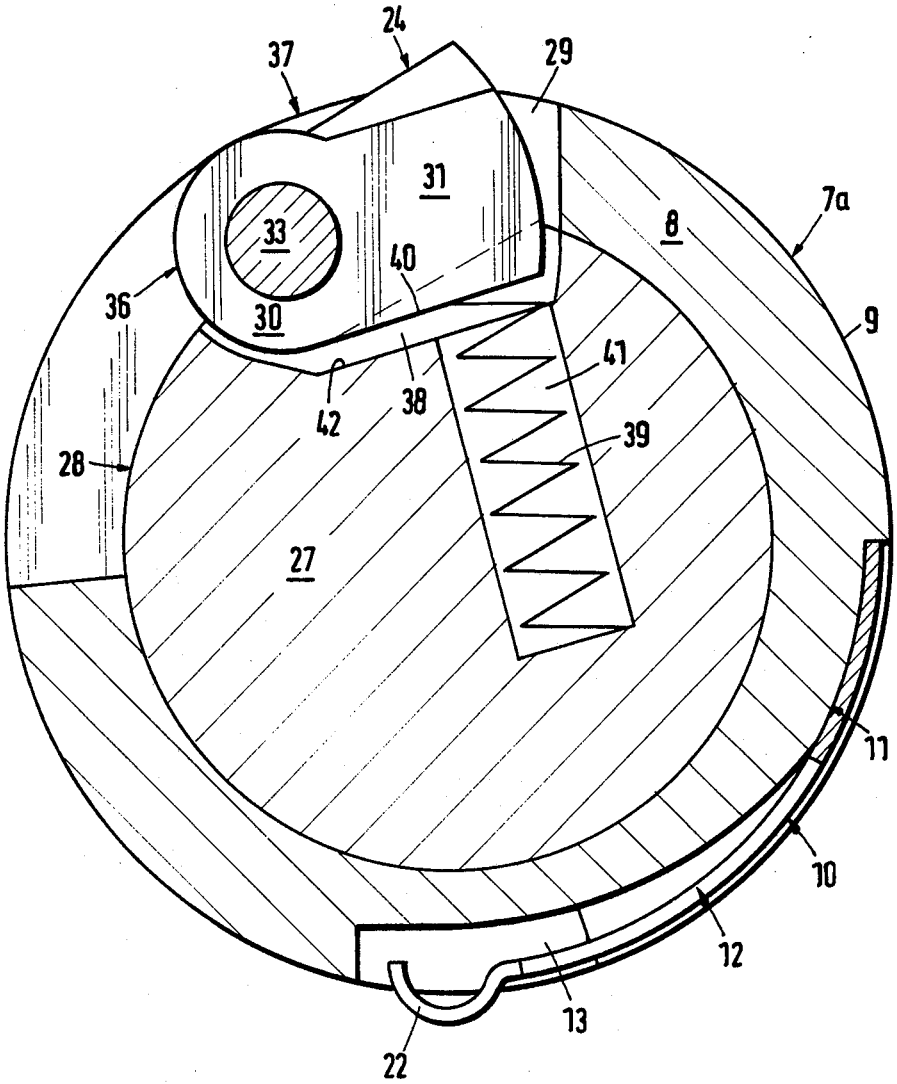
FIG. 2 is a partial side view of the embodiment shown in FIG. 1.

A ratchet shaft 27, by means of which the printing wheels 3*a* running on the peripheral surface 9 of the sleeve 8 are advanced, extends through the sleeve 8 (FIG. 2). The ratchet shaft 27 is for example a cylindrical solid body which is mounted for rotation in the interior of the sleeve 8. The rotary movement of the ratchet shaft 27 is limited by suitable stops to an angle which corresponds to one feed step of the printing wheels 3*a*. On the periphery 28 of the ratchet shaft 27 are disposed the pawls 24, which engage, through a gap 29 in the wall of the sleeve 8, in the rim gears 28 and 20 on the inner ring 17 of the printing wheels 3*a* and drive the latter when the ratchet shaft 27 is turned. The gap 29 together with the pawls 24 is expediently disposed on that side of the locking shaft 7*a* which is diametrically opposite the leaf spring 12.

Each of the pawls 24 consists of a substantially cylindrical pivot member 30 having a central bore and of an extension 31 which projects radially therefrom and is shaped as a negative of the detent noches 19 and 21 in which it engages like a tooth (FIG. 2). The pawls 24 are mounted side by side by means of the bores 32 of their pivot members 30 on a cylindrical pin 33 serving as a common shaft.

The pin 33 is mounted parallel to the ratchet shaft 27, in two carriers 34 and 35 fixed on the periphery of the said shaft (FIG. 1). In a particularly advantageous embodiment these carriers 34 and 35 serve at the same time as a stop limiting the angular extent of the rotation of the ratchet shaft. The pawls 24 are strung on the pin 33 by their pivot members 30, lying against one another with clearance in each case and in alignment in lateral projection, and are rotatable with movement play about the said pin. The axial centre of the pin 33 is so situated that the external dimension 36 of the pivot member 30 of a pawl 24 mounted on the pin 33 always lies inside an extended outer peripheral circle 37 of the sleeve 8. The pawls 24 are thus recessed with their pivot member 30 in the bearing surface of the printing wheels 3*a*. A printing wheel 3*a* turning on the locking shaft 7*a* slides away over the pivot mounting of the pawls 24. In a particularly advantageous embodiment the axial centre of the pin 33 is so situated that the exterior dimension 36 of the pivot member 30 of a pawl 24 mounted on the pin 38 is just tangent, in lateral projection (FIG. 2), to the extension of the outer peripheral circle 37 of the sleeve 8. In the region in which the wall of the sleeve 8 is interrupted by the gap 29 for the pawls 24 the printing wheels are thus guided on the pivot members 30 of the pawls 24.

The pawls 24 mounted on the pin 33 can be lowered into a recess 38 in the ratchet shaft 27 by rotation about the pin 33, in such a manner that the extension 31 lies within the extended peripheral circle of the sleeve 8. In this position the extension 31 is set back under the running surface of the printing wheels 3*a* and is not in engagement with the rim gears 18 and 20. The pawls 24 are however in this position independently loaded by the force of respective compression springs 39 which act on the extension 31 of the pawls 24. The compression springs 39 act on those surfaces 40 of the extensions 31 which are remote from rim gears 18 and 20, and thus exert a force which turns the pawls 24 about the pin 33 and causes the extensions 31 to engage radially outwards into the detent notches 19 and 21 of the rim gears 18 and 20. The engagement is thus effected by an epicyclic movement of the pawl 24 relative to the rotation of the ratchet shaft 27. For this purpose the compression springs 39 are mounted in bores 41 which are driven from the rest surface 42 of the pawls 24 in the recess 38 of the ratchet shaft 27 approximately at right angles into the material of the ratchet shaft 27. In order to achieve maximum leverage, the bores 41 lead onto those surfaces 40 of the extensions 31 which are to be acted on at a point lying at the greatest possible distance from the pivot point of the pawls 24.

The mode of operation of the decimal progression of the printing wheel propulsion in this form of construction of the printing mechanism 1*a* is as follows:

The printing wheels 3*a* are offset on the locking shaft 7*a* in relation to the pawls 24 in such a manner that a pawl 24 engages over the junction of two printing wheels 3*a*. By half its width the pawl 24 engages in each case in the rim gear 20, on the driven side, of a low place printing wheel 3*a*, and by the other half of its width in the rim gear 18, on the driving side, of the next higher place printing wheel 3*a*. An exception is made in the case of the pawl 44 which drives the lowest place printing wheel 43, this pawl working only with the rim gear 18 on the driving side of this printing wheel 43 and freewheeling over half its width. For each printing stroke of the printing mechanism 1*a* the ratchet shaft 27 is turned to-and-fro between its stop positions by means of a driving lever 45, while in each case the pawl 44 driving the lowest place printing wheel 43 comes into engagement and drives the printing wheel 43. The pawl 46 associated with higher numerical places runs by half its width on the rim gear 20 on the driven side of the lowest place printing wheel 43 and is thereby prevented from engaging in nine out of ten ratchet operations. Only when the pawl 44 driving the lowest place printing wheel 43 engages in the continuous detent notch 26 can the associated pawl 46 also engage therein and drive the next higher place printing wheel 47.

Higher decimal places are in principle advanced similarly through the engagement of additional pawls 24 between respective neighbouring printing wheels 3a. Pairwise arrangement of neighbouring printing wheels 3a is however not sufficient for this purpose. On the contrary the pawls 24 must be coupled in such a manner that on the one hand the operation of a low place pawl 24 is ensured independently of and without being influenced by all higher place pawls, and that on the other hand the engagement of a pawl is prevented until all the pawls associated with lower places have likewise engaged.

In order to meet this requirement a projection 48 is formed on the extension 31 of each pawl 24 towards the driven side, while towards the driving side a groove 49 is formed, in which the projection 50 of the preceding pawl 24 on the driving side can engage (FIGS. 7 to 9). The axially extending projection 48 is formed approximately centrally on the extension 31 of the pawl 24. The rotary movement of the pawl 24 about the pin 33 takes place in an arc of a circle about the pin 33. The radial side surfaces 51 and 52 of the projection 48 and the corresponding side walls 53 and 54 of the groove 49 have the shape of the lateral areas of the cylinders described thereby. The width of the projection 48 and groove 49 corresponds approximately for example to half a pawl width. The groove 49 is bounded on the side facing the ratchet shaft 27, when the pawls are installed, by a stop surface 55 which defines a maximum depth of penetration of the projection 50 on the preceding pawl 24 on the driving side. The depth of the groove is so selected that in this position of maximum penetration depth the pawls are in line, viewed in the axial direction. Towards the opposite side, facing the rim gears 18 and 20 of the printing wheels 3a when the pawls are installed, the movement of the projection 50 in the groove 49 is on the other hand not limited. Consequently, the pawls 24 are coupled together only in one direction of movement about the pin 33.

If, for example, a pawl 24 is released from its position of engagement with the rim gear 18 associated with it on the driving side by the rim gear 20 associated with it on the driven side, the appertaining projection 48 is at the same time guided towards the stop surface 55 of the groove 49 of the following next higher pawl 24, and the latter is likewise lifted out. The process is continued for all the higher place pawls 24. Thus, none of these pawls 24 comes into engagement. On the other hand, the free play of all the preceding low place pawls 24 is not affected. The coupling of the pawls 24 in the manner described, in conjunction with the association of one pawl 24 in each case with a pair of neighbouring printing wheels 3a having rim gears 18 and 20 with a reduction ratio of 1:10, thus results in the desired decimal advance.

The printing mechanism 1a described, which advances in decimal progression with every printing stroke, can be extended in a simple, flexible manner to form a printing mechanism with multiple or repeat advance, in which the set of numbers for progressive numbering is advanced by one digit only after each n-th printing stroke. For this purpose the lowest place printing wheel 43 advanced on each printing stroke is replaced by a suitable control cam. FIGS. 5 and 6 show a form of construction of a control cam 56 for a printing mechanism advanced with twofold reduction ratio. The control cam 56 corresponds in construction to that of a printing wheel 3a not provided with a type rim gear 15 and in which the reduction ratio from the driving side rim gear to the driven side rim gear has been modified in accordance with requirements.

In the control cam 56 illustrated the rim gear 57 on the drive side is provided with ten driving notches 58 disposed with angular spacing of 36°, while the rim gear 59 on the driven side is provided with five driven notches 60 disposed with angular spacing of 72°. The driven notches 60 are in line with every second driving notch 58, so that the control cam 56 has a total of five through-notches disposed with angular spacing of 72°. A pawl 24 (44), which advances the control cam 56 one position for each printing stroke, engages in the rim gear 57, on the driving side, of the control cam 56. The pawl 44 driving the lowest place printing wheel 47 directly next to the control cam 56 now acts by half its width on the driven side rim gear 59 of the control cam 56 and thus comes into engagement only on each second printing stroke. The printing mechanism 1a is thus advanced only for every second printing stroke.

Control cams for the advance of the printing mechanism 1a with repetition with more than a twofold reduction ratio are constructed in a similar manner. In a particularly advantageous embodiment the driving side rim gear of the control cam has twelve driving notches (not shown) disposed with angular spacing of 30°. The continuation of every second, third, fourth, or sixth notch to the driven side of the control cam then brings about the advance of the printing mechanism 1a with a corresponding multiple reduction ratio. A control cam having duodecimal spacing can be used together with decimal advance printing wheels after slight modification of the locking shaft or pawls, because the difference in the advance angle is comparatively slight.

In printing apparatus with multiple or repeated advance, in contrast to the printing mechanisms first described above, a control cam replaces the lowest place printing wheel. For reasons of uniformity in the number of printing places, even in printing apparatus without multiple advance the decimal advance printing mechanism may also be preceded by a control cam (not shown). A control cam of this type has, with decimal or duodecimal symmetry as desired, a rim gear provided exclusively with through-notches.

As already mentioned, the first pawl 44 on the drive side works with only half its width on the driving side rim gear 18 of the lowest place printing wheel 43 or of the control cam 56. The other half of the width of the pawl freewheels and in conjunction with an adjusting slide can be used for putting out of action the automatic advance of the printing mechanism 1a. The adjusting slide (not shown) is for example a flat member sliding in a guide and adapted to be locked in two fixed positions. In one fixed position the adjusting slide is out of action and in the other it acts on the otherwise freewheeling half of the first pawl 44 on the driving side. The corresponding end of the flat member is for this purpose cut in the shape of an arc of a circle the radius of curvature of which corresponds to that of the outer peripheral surface of the sleeve 8. The length of the arc of a circle is so selected that this arc covers the gap 29 formed in the wall of the sleeve 8 for the pawls 24. In order to put the automatic advance of the printing mechanism out of action, the arcuate end of the adjusting slide is guided, on the driving side of the lowest place printing wheel or of the control cam, directly over the extended outer peripheral circle 37 of the sleeve 8. The adjusting slide is locked in this position and by its arcuate end loads the first pawl 44 on the driving side. This pawl is brought back under the running surface of the printing wheels 3a and thus lifted out of the driving position. Through the pawl coupling arrangement described all the other pawls 24 are lifted out simultaneously with the first pawl 44 on the driving side, so that the advance of the printing mechanism 1a is interrupted. During the following printing strokes the first pawl 44 on the driving side slides on the arcuate end of the adjusting slide. It thus remains lifted out of its driving position over the entire advance angle of the ratchet shaft 27. The adjusting slide can be returned by hand to the other fixed position at any time when required, the automatic advance being freed in this other position.

In the second example of embodiment of the invention (FIGS. 10 to 18) the locking shaft 7b is provided with a ball detent system. On their outer periphery 61 (FIG. 13) the printing wheels 2b and 3b are facetted substantially in the shape of a uniform decagon. The printing types 62 are disposed approximately at the centre of the resulting tangential surfaces 63. At the junction between each two neighbouring tangential surfaces 63 and 64 a rectangular groove 65 is cut, in which suitable advancing members of a hand operated adjusting device (not shown) engage. With the aid of this adjusting device the adjustment of the printing wheels 2b and 3b can be preselected in the maner previously described.

The printing wheels 2b and 3b have a central axial bore 66 through which a locking shaft 7b is inserted. The annular surface bounding this axial bore 66 is in the form of a stepped rim 67 having ten notches 68 disposed with regular angular spacing. The decimal spacing of the stepped rim 67 corresponds to that of the outer type rim gear. One or more spring-loaded balls or shafts (not shown) of the locking shaft 7b engage in the notches 68 of the stepped rim 67 and position the printing wheels 2b and 3b in their respective printing position.

In contrast to the first embodiment of the invention, in the present case the notches 68 on the inner ring surface of an automatically advanced printing wheel 3b are not acted on by advancing members. The advancing members working with a decimal reduction ratio act on the contrary on the side surfaces 69 and 70 of the printing wheels 3b.

Each of the two side surfaces 69 and 70 of an automatically advancing printing wheel 3b is provided with a concentrically surrounding step shoulder 71 and 72, these being cut out of the solid material of the printing wheel 3b with identical inside widths. The step shoulder 71 on the driven side serves to receive a resilient coupling disc 73 which is adapted to be recessed flush in the step shoulder 71. The face 74 of the step shoulder 72 on the driving side is on the other hand provided with a plane toothing 75 (FIGS. 13 and 14) in which the coupling disc 73 of the respective preceding lower place printing wheel 3b engages.

The plane toothing 75 has decimal symmetry corresponding to that of the outer type rim gear. It directly adjoins the outer peripheral step 76 of the step shoulder 72 on the driving side. The individual teeth 77 of the plane toothing 75 are sliding planes which rise from the face 74 of the step shoulder 72 to the height of the side surface 70 of the printing wheel 3b. In relation to the axis of the printing wheel 3b the rise takes place over an angle of 18° and breaks off in a step 78. At this step 78 the plane toothing 75 drops onto the face 74 of the step shoulder 72 and remains at this height over an angular range of likewise 18°, so that a gap 79 is formed in the plane toothing 75. This gap 79 is followed by the next tooth 77. The teeth 77 are cutouts of circular sectors and are bounded radially inwards by arc segments 80 of a concentric inner ring edge 81.

The coupling disc 73 is substantially a flat ring 82 (FIGS. 16 and 17) of spring steel having a circular central opening 83 and two lugs 84 and 85 projecting radially outwards. The circular opening 83 has an inside diameter which corresponds at least to the maximum inside width of the stepped rim 67 of a printing wheel 2b;3b. The coupling discs 73 can thus be strung on the locking shaft 7b like the printing wheels 2b;3b. The outside diameter of the flat ring 82 is slightly smaller than the diameter of the inner ring edge 81 of the plane toothing 75. The flat ring 82 of the coupling disc 73 of a low place printing wheel 3b thus always runs radially inside the plane toothing 75 of the next higher place printing wheel 3b.

The lugs 84 and 85 (FIGS. 16 and 17) are formed at diametrically opposite sides of the flat ring 82. The outside diameter of the lugs 84 and 85 corresponds to the inside width of the step shoulders 71 and 72 of the printing wheel 3b. The lugs 84 and 85 act as locking lug 84 and holding lug 85 respectively. The coupling disc 73 lies flush in each case in the driven side step shoulder 71 of the printing wheel 3b and by means of the holding lug 85 is made fast to the printing wheel 3b. For this purpose the holding lugs 85 and the printing wheel 3b have countersunk mounting holes 86 and 87 which are in line with one another and by means of which they can be rivetted or pinned together.

The oppositely situated locking lug 84 engages, as advancing member, in the gaps 79 of the plane toothing 75 of the respective following higher place printing wheel 3b, and is lifted out of engagement again by its inherent resiliency and with the aid of the sliding planes of the teeth 77. The locking lug 84 is in the shape of the negative of a gap 79 of the plane toothing 75. It is provided with a pin 88 which projects axially out of the plane of the flat ring 82 and which has a rounded head. When the coupling disc 73 is installed the pin 88 runs with play in a through-bore 89 (FIG. 13). This through-bore 89, which in the embodiment illustrated is slightly oval, is formed in a well defined gap 90 in the plane toothing 75 and connects the step shoulder 71 on the driven side to the step shoulder 72 on the drive side in the printing wheel 3b. When the coupling disc is installed the pin 88 thus passes through from the driven side to the driving side of the printing wheel 3b. In the unloaded position the coupling disc 73 is recessed in the driving wheel 3b. The length of the pin 88 is so selected that in this position it projects through the through-bore 89 beyond the face 74 of step shoulder 72 on the drive side.

In contrast to the first example of embodiment of the invention, in the present case, the drive for the automatic advance of the printing mechanism 1b acts only on the lowest place printing wheel 91. This printing wheel 91 is therefore modified in relation to the other printing wheels 3b. On its driving side it carries a ratchet wheel 92 (FIG. 12) which is rigidly joined to the printing wheel 91. The ratchet wheel 92 may for example be rivetted or pinned to the printing wheel 91 by means of aligned mounting through-bore 93, 94, 95, 96. In a manner known per se a lever-operated pawl 97 engages with the ratchet wheel 92 and advances the latter, and consequently also the printing wheel 91, one step for each printing stroke. The ratchet wheel 92 has a through-bore 98 which in the installed position is in line with the through-bore 89 of the printing wheel 91. The pin 99 of the coupling disc 100 of the lowest place printing wheel 91 is extended in such a manner that it projects through the aligned through-bores 89 and 98 beyond the face 101 of the ratchet wheel 92.

The head of the pin 99 (FIG. 10) cooperates with an advance cam 102 on which the ratchet wheel 92 runs. On the rotation of the lowest place printing wheel 91 about the locking shaft 7b, the pin 99 describes a circle on the advance cam 102. On the periphery of this circle the advance cam 102 has only one boss 103. The latter is exactly in alignment with the pin 99 in the axial direction when the digit nine of the lowest place printing wheel 91 faces the printing surface. The head of the pin 99 then slides onto the boss 103 (see FIG. 10), whereby the coupling disc 100 is deflected, against its internal spring tension, out of the driven side step shoulder 71 of the lowest place printing wheel 91. The necessary pivoting movement of the pin 99 in the through-bores 89 and 98 is made possible by their oval shape. The deflected coupling disc 100 engages by its locking lug 84 in the plane toothing 75 of the next higher place printing wheel 104 and acts as a driver, which on the next printing stroke effects the simultaneous advance of both printing wheels 91, 104. On completion of an advancing operation the coupling disc 100 is moved back into the position of rest because of the rectangular fall of the advance cam and of its inherent resiliency. The disconnection is effected in the locking range of the ball locking shaft, that is to say during the movement of the printing wheels. The thickness of the material of the coupling discs 73 should be selected in accordance with the desired spring force, although a minimum thickness for reliable engagement with the plane toothing 75 must be ensured.

Decimal advance of a higher place printing wheel 3b is effected when the pins 88 of all preceding low place coupling discs 73 are in line with the boss 103 of the advance cam 102. The coupling discs 73 then encounter by their locking lugs 84 those gaps 90 in the plane toothing 75 of the next higher place printing wheel 3b which are provided with a through-bore 89. The pins 88 projecting out of them supply the deflecting force of the boss 103 through all the lower place printing wheels 3b. Through this form of coupling a higher place printing wheel 3b is obviously advanced only simultaneously with all preceding lower place printing wheels 3b, that is to say correct decimal progression is achieved.

The second embodiment of the printing mechanism 3b of the invention can also be equipped in a simple manner with multiple or repetition advance. For this purpose a sensing lever 106, which is in engagement with a reduction cam 107 (FIG. 18), is mounted on a common shaft 105 with the pawl 97. The pawl 97 and the sensing lever 106 are rigidly coupled together through the shaft 105. The reduction cam 107 may, as illustrated (FIGS. 10 and 11), be mounted on the driven side of the printing mechanism 1b next to the printing wheels 2b which can be adjusted only manually. Any other arrangement is however also possible. The sensing lever 106 acts on a notched rim 108 of the reduction cam 107, on which every second notch 109 is recessed radially inwards and for each printing stroke advances the reduction cam 107 one step. The pawl 97 is staggered behind the sensing lever 106 and comes into engagement with the ratchet wheel 92 only when the sensing lever 106 engages in one of the recessed notches 109. The printing mechanism 1b is thus advanced only for every second printing stroke. Reduction cams for any other desired reduction of the counting operation can be used similarly.

In both the abovedescribed forms of construction of the printing mechanism of the invention the automatic advance acts only in one well defined propulsion direction on the printing wheels 3a;3b. This is achieved without constraint from the asymmetry of the ratchet toothing with which the respective advancing members engage. The partial aim of the invention of providing a printing mechanism subject to little wear is served in particular in that the hand operated adjusting means moves the printing wheels 3a,3b exclusively in the same propulsion direction (not illustrated). The coupling shaft of the adjusting means is for this purpose provided with a freewheel which slips on rotation of the adjusting knob in the opposite direction. The freewheel may consist of a sling spring placed around the coupling shaft or be of other construction known per se.

We claim:

1. In a printing device comprising a frame, plural individually rotatable printing wheels, and holding means for holding each wheel individually in a particular rotated position, each of said printing wheels mounted by an axial bore along the longitudinal axis of a common rotatable shaft, at least two of said wheels being counting wheels having numerical characters spaced about and on an outer periphery thereof such that each counting wheel provides a different place of a plural place number, mechanical advancing means for consecutive, stepwise rotary indexing of said counting wheels to consecutive counting positions, said advancing elements coupleable together in a predetermined counting rhythm such that two adjacent counting wheels are rotatable together by one of said advancing elements according to said rhythm, the improvement comprising:

each of said counting wheels comprising a driving side surface and a driven side surface such that the driven side surface of each counting wheel abuts and slidably engages the driving side surface of a higher place wheel, each driving side and driven side being recessed, respectively, to provide a driving side recess and a driven side recess within which said position holding means and said advancing means are concealed from said outer periphery and actuatable during said indexing such that closer spacing of each place of said plural place number is provided.

2. An improvement as in claim 1, wherein said holding means comprises spring biased elements engageable in notches in said axial bore to provide said holding.

3. An improvement as in claim 2, wherein said counting wheels comprise higher, lower, and lowest place counting wheels and wherein:

said advancing means comprises pawls corresponding in number to said counting wheels, said pawls pivotally supported on said shaft and biased into engagement with means in said driving side recess of a corresponding counting wheel for indexing said corresponding counting wheel, each of said pawls, other than a lowest place pawl corresponding to said lowest place counting wheel, further engageable in means in said driven side recess of an adjacent lower place counting wheel such that a higher place counting wheel is indexed by engagement of the corresponding pawl with said driven side recess indexing means of an adjacent lower place counting wheel according to said rhythm.

4. An improvement as in claim 2, wherein:

said holding means further comprises a cylindrical sleeve surrounding said shaft and fixed to said frame with separate spring fingers each engageable in the notches of a respective corresponding wheel, said sleeve providing bearing support for said wheels.

5. An improvement as in claim 3, and further comprising:

disengage means in said driven side recess for moving said pawls out of biased engagement with said driven side indexing means, such that a counting wheel is not rotated by a pawl corresponding to a lower place counting wheel, according to said rhythm.

6. An improvement as in claim 5, wherein said advancing means further comprise:

interconnection means between pawls for disengaging at least one higher place pawl from said driving side recess indexing means of the corresponding higher place counting wheel and not disengaging at least one lower place pawl from said driven side recess indexing means of a lower place counting wheel according to said rhythm.

7. An improvement as in claim 6, wherein said interconnection means further comprise:

a projection from and a groove in each pawl, the projection of a pawl slideably received in said groove of an adjacent pawl, said groove having a stop for driving engagement by said projection such that an adjacent higher place pawl is disengaged from the driving side recess indexing means of a corresponding higher place counting wheel and an adjacent lower place pawl is not disengaged from the driven side recess indexing recess of the corresponding lower place counting wheel according to said rhythm.

8. An improvement as in claim 2, and further comprising:

means for changing said rhythm.

9. An improvement as in claim 2, and further comprising:

manually adjustable non-counting wheels.

10. An improvement as in claim 2, wherein:

said advancing means comprises teeth spaced about said driving side recess and a resilient disc attached in said driven side recess, said disc having an actuating pin extending through said counting wheel and generally parallel to said longitudinal axis and beyond said driving side surface; and means for displacing said disc into engagement with said teeth of an adjacent counting wheel and indexing said counting wheels according to said rhythm.

11. An improvement as in claim 10, wherein said counting wheels further comprise a lowest place counting wheel and said advancing means further comprises:

a ratchet wheel attached to said lowest place counting wheel and cooperating with a ratchet pawl pivotally attached to said frame to provide said indexing upon rotation of said shaft.

12. An improvement as in claim 2, wherein said frame further comprises:

cam means for engaging the actuating pin of said lowest place wheel to displace the disc of said lowest place wheel.

13. An improvement as in claim 11, and further comprising:

means for changing said rhythm.

14. An improvement as in claim 11, said rhythm changing means comprising:

a sensing lever mounted on said frame for rotation with said ratchet pawl and engageable in cam notches of a reduction cam, such that said ratchet wheel is prevented from indexing said counting wheels when said sensing lever is not engaged in one of said cam notches.

* * * * *